United States Patent [19]

Agrawal et al.

[11] 4,269,053

[45] May 26, 1981

[54] METHOD OF SUPERPLASTIC FORMING USING RELEASE COATINGS WITH DIFFERENT COEFFICIENTS OF FRICTION

[75] Inventors: Suphal P. Agrawal, Torrance; Edward D. Weisert, Rolling Hills Estates, both of Calif.

[73] Assignee: Rockwell International Corporation, El Segundo, Calif.

[21] Appl. No.: 60,263

[22] Filed: Jul. 25, 1979

[51] Int. Cl.[3] ..... B21D 37/18

[52] U.S. Cl. ..... 72/42; 72/46; 72/60

[58] Field of Search ..... 29/DIG. 45; 72/DIG. 28, 72/41, 42, 46, 47, 60, 350, 351

[56] References Cited

U.S. PATENT DOCUMENTS

| | | | |
|---|---|---|---|
| 3,655,349 | 4/1972 | Shah et al. | 72/42 X |
| 3,927,817 | 12/1975 | Hamilton et al. | 228/157 |
| 3,934,441 | 1/1976 | Hamilton et al. | 72/60 |
| 3,979,815 | 9/1976 | Nakanose et al. | 29/DIG. 45 |
| 4,055,975 | 11/1977 | Serfozo et al. | 72/42 |
| 4,096,076 | 6/1978 | Spiegelberg | 72/42 X |

*Primary Examiner*—Ervin M. Combs
*Attorney, Agent, or Firm*—Louis L. Dachs; Charles T. Silberberg

[57] ABSTRACT

An improvement to the method of making a structure by superplastic forming, wherein portions of a preform are expanded, in the superplastic condition, against a forming member, is disclosed. The improvement comprises the step, prior to expanding the preform, of providing a lower coefficient of friction between the portions of the preform to be expanded and the forming member than which exists between the portions of the preform where expansion is intended to be minimal and the forming member. The two values of coefficient of friction are obtained by applying first and second release coatings to the portions of the preform to be expanded and those where expansion is to be minimal respectively, with the first release coating having a coefficient of friction less than the second release coating. Alternately, the first and second release coatings can be applied to the forming member. The preferred first and second release coatings are boron nitride and yttria respectively.

15 Claims, 7 Drawing Figures

METHOD OF SUPERPLASTIC FORMING USING RELEASE COATINGS WITH DIFFERENT COEFFICIENTS OF FRICTION

BACKGROUND OF INVENTION

1. Field of Invention

The invention relates to the field of metal forming and, in particular, to an improvement to the process of superplastic forming of structures wherein a portion of a heated preform is expanded against the surface of forming member. Specifically, it relates to a method of selectively applying coatings to the forming member or the preform, which produce different coefficients of friction between portions of the preform and the forming member during expansion, providing a more uniform thickness profile in the structure thus formed.

2. Description of the Prior Art

Superplasticity is the capability of a material to develop unusually high tensile elongation with a reduced tendency toward local necking during deformation at elevated temperatures. Alloys which exhibit superplasticity are capable of being subjected to superplastic forming wherein portions of a preform are expanded, by the application of fluid pressure, against the surface of a forming member, usually in the form of a die, to produce structures of predetermined shapes. Such expansion is in the form of an increase in the surface area produced by an elongation in the length and a reduction in thickness of individual material elements. The process has been recently combined with diffusion bonding to produce structures typically costing 50% less to fabricate, while often achieving a 30% weight reduction over conventional fabrication techniques.

But many of these metals are subject to surface contamination at forming temperatures. Such metals are termed "reactive" metals, and include alloys of titanium and zirconium. Therefore, during forming at high temperatures the preform must be protected by an inert release coating so that it does not react with the forming member itself. A release coating typically is formulated to prevent sticking of the preform to the forming member. In superplastic forming its primary purpose is to act as a releasing agent so as to facilitate the removal of the expanded preform from the forming member. This coating will also affect the sliding friction of the preform in the forming member during expansion. There are several commercially available release coatings which are suitable which usually contain compounds of alumina, graphite, boron nitride or yttria.

Expanding a preform in a superplastic condition differs from the more conventional expanding processes. For example, U.S. Pat. No. 3,769,834, Deep Drawing Method by Wayne C. Granzow, discloses a method of room temperature drawing of aluminum wherein a flat preform is clamped at its periphery over a die cavity. A punch is used to drive the preform into the cavity, drawing in metal from under the clamped portion.

In superplastic forming operations, which is disclosed in U.S. Pat. No. 3,934,441, Controlled Environment Superplastic Forming of Metals by C. H. Hamilton, et al., the preform is clamped firmly at its periphery, thus ideally allowing for material to be drawn from this area. However, due to a combination of the compressive forces from the forming member and tensile forces from the fluid pressure applied to the expanding portions of the preform, some expanding in the form of elongation or stretching occurs at the periphery. Such elongation or stretching also occurs in the forming member cavity entrance radius area, i.e., the intermediate region between the peripheral portion of the preform and the part expanding into the cavity. As the preform drapes over the radius area there is a tendency to increase the rate of material elongation which, in turn, may produce local necking in this area. This makes it difficult to obtain uniform thickness profiles in the structure. For example, when fabricating a simple hat section, if a release coating which is capable of producing a high coefficient of friction is used, such as one containing yttria, there is an increase in the frictional force and a lower net force causing material expansion. Thus there is a reduction in the expansion itself. The result is that the preform remains thick at the radius area, while, the portion expanded within the cavity will have an uneven thickness profile. If a release coating which produces a relatively low coefficient of friction is used, such as one containing boron nitride, there is a more uniform thickness profile obtained in the portion expanded into the cavity, but pronounced local thinning near the radius area.

Accordingly, one object of this invention is to provide an improved superplastic forming process.

Another object of this invention is to provide a process which produces a more uniform thinning profile of a structure produced by superplastic forming.

A further object of this invention is to provide a coating process for use in superplastic forming which provides both a more uniform thinning profile of the structure thus formed, while reducing surface contamination and facilitating release of the formed structure from the forming member.

SUMMARY OF INVENTION

The superplastic forming of structures essentially involves the heating of a preform to a temperature in the range wherein the material exhibits superplasticity. Thereafter, portions of the preform are expanded against a surface of a forming member, complimentary to the shape of the structure, while other portions are not expanded, resulting in some portions becoming thinner than others. The instant invention relates to an improvement to the process described above which provides a more uniform thickness profile.

More specifically, the improvement comprises the step, prior to expanding the preform, of providing a lower coefficient of friction between the portions of the preform to be expanded and the surface of the forming member than which exists between the portions of the preform where expansion is to be minimal. The lower coefficient is provided by providing a first release coating on the portions of the preform to be expanded and a second release coating on the portions of the preform where expansion is to be minimal, with the first release coating having a coefficient of friction less than the second release coating. Alternately, the first and second release coatings can be applied to the surface of the forming member. The preferred first release coating is boron nitride and the preferred second release coating is yttria.

The novel features which are believed to be characteristic of the invention, both as to its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only, and are not intended as a definition of the limits of the invention.

DESCRIPTION OF PREFERRED EMBODIMENT

A number of metals, for example, alloys of titanium and zirconium, exhibit the property of developing unusually high tensile elongation with a reduced tendency toward local necking during deformation at elevated temperatures. This property is called superplasticity. Typically, superplastic forming (hereafter abbreviated to "SPF") of structures is accomplished by heating a preform made of such a material to a temperature in the range where it exhibits superplasticity and expanding portions of the preform against the surface of a forming member having a shape complimentary to that of the structure to be formed. This process is discussed in detail in U.S. Pat. No. 3,934,441, Controlled Environment Superplastic Forming of Metals by C. H. Hamilton, et al. The combining of superplastic forming with diffusion bonding is fully discussed in U.S. Pat. No. 3,927,817, "Method for Making Metallic Sandwich Structure," by C. H. Hamilton, et al. These patents are herewith incorporated by reference and thus a detailed discussion of the processes is not necessary. The instant invention relates to an improvement to the above process wherein localized thinning of the preform is greatly reduced or completely eliminated.

Figure 1:
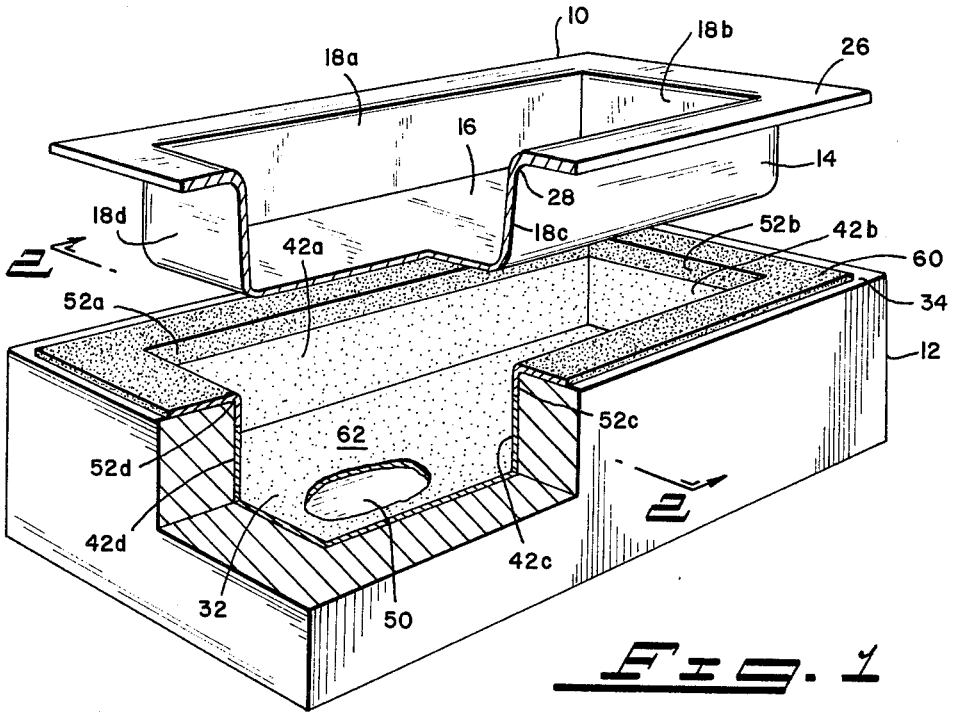
FIG. 1 is an exploded perspective view of a rectangular shaped structure used as a sample to illustrate the method, and a die used to form the structure.

Illustrated in FIG. 1 is an exploded perspective view of a rectangular-shaped structure 10, which is typical of the parts that can be manufactured by SPF, and its forming member, in this case a die 12. The structure 10 consists of a cup section 14 having a bottom 16 and walls 18 *a, b, c, d,* and a flat flange portion 26 attached to the walls. The die 12 has a cavity 32, which has a shape complimentary to the cup portion 14, and a top surface 34 conforming to the flange portion 26 of the structure 10. Ideally in the structure 10, the expansion, and therefore concurrent elongation and thinning, should have occurred in the bottom 16 and walls 18 *a–d,* and not in the flange portion 26 or radius area 28. Until the development of the instant invention, this ideal configuration was not approachable.

Still referring to FIG. 1 and additionally to FIG. 2, which is a cross-sectional view of the die 12 along the lines 2—2 shown in FIG. 1, illustrating the different forming stages that a preform 36, in the form of a flat sheet, undergoes as it is expanded into the cavity 32 of the die 12. Referring particularly to FIG. 2*a*, the preform 36 is shown placed on the surface 34 of the die 12 and clamped in place (by means not shown).

Prior to placing the preform 36 on the surface 34 of the die 12, either the preform 36 or the die 12 must have release coatings (hereafter referred to as "coatings") applied thereto. The coatings are necessary for several reasons. Primarily, the coating must serve as a releasing agent in order to facilitate the separation of the preform 36 from the die 12 after expansion. Secondly, during the forming operations the preform 36 will be forced into the cavity 32 and expanded against the side surfaces 42*a, b, c, d,* and bottom surface 50 of the die 12, and a considerable amount of frictional force will be created. Thus, the coating must provide lubrication between the preform 36 and the side surfaces 42*a–d,* and the bottom surface 50 in order to promote sliding during expansion and to prevent galling, which will increase wear and reduce die life. Finally, if the preform 36 is made of a reactive metal, such as titanium, the coating must also alleviate or prevent any chemical reaction between the preform 36 and the die 12, otherwise the structural characteristics of the structure 10 would be degraded.

The coatings usually contain compounds, such as, yttria, boron nitride, graphite, or alumina, in an organic binder. The coatings are applied to either the preform 36 or the die 12 by conventional methods such as spraying or silk screening. These processes are described in detail in our co-pending U.S. patent application, Ser. No. 936,982, "Improved Method and Composition for Fabricating Superplastically Formed/Diffusion Bonded Structures." While the use of a single coating, selected from the above group, is suitable for use in conventional hot forming or forging processes, problems arise when a single coating is used in the SPF process. If a coating containing a compound such as yttria, which produces a high coefficient of friction between the preform 36 and the die 12, is used, it results in a non-uniform thickness in the cup portion 14 of the structure 10. The use of a coating containing a compound such as boron nitride, which creates a relatively low coefficient of friction between the preform 36 and die 12, results in a uniform cup portion 14, but local necking occurs in the radius area 28 of the structure 10. The reasons for these occurrences will be subsequently discussed.

Figure 2A:
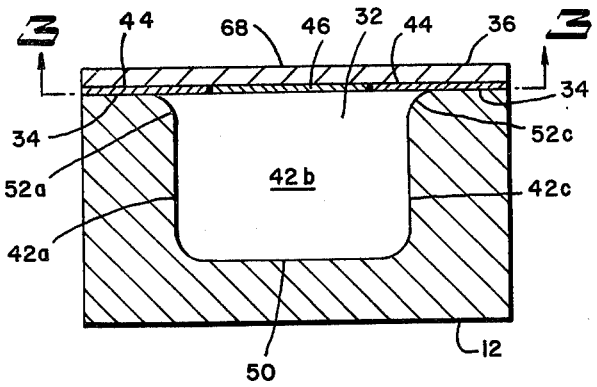
FIGS. 2*a*–2*d* are a cross-sectional views of a die and a preform along the lines 2—2 shown in FIG. 1 at several different stages in a superplastic forming procedure.
Figure 2B:
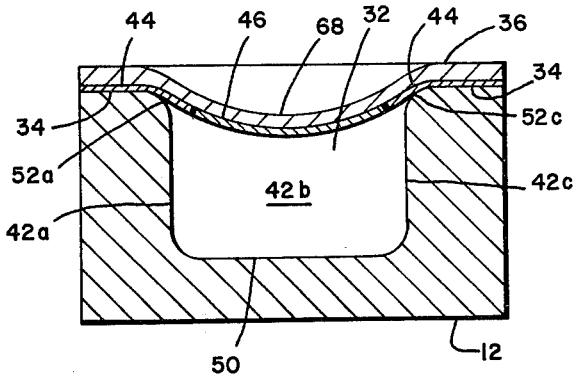
Figure 3:
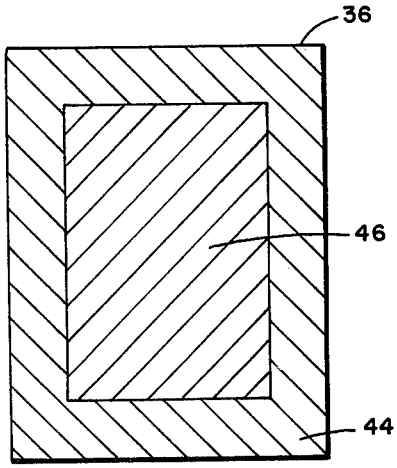
FIG. 3 is a view along the line 3—3 illustrated in FIG. 2 showing the underside of the preform.

As previously mentioned these problems are eliminated or significantly mitigated by the instant invention. Illustrated in FIG. 3 is a view along the lines 3—3 illustrated in FIG. 2*a*, showing the underside of the preform 36. A coating 44 capable of producing a high coefficient of friction is applied to the area of the preform 36 which is to undergo little or no expansion. This coating preferably is a compound containing yttria. A coating 46 capable of producing a low coefficient of friction, preferably a compound containing boron nitride, is applied in the area to undergo extensive expansion. Simply put, the coatings are applied so that the coefficients of friction produced during expansion are in essentially inverse proportion to the amount of expansion or elongation to be undergone by the portions of the preform 36. In actuality, the thickness of the coatings is between 0.001 and 0.005 inches and is shown enlarged only for purposes of illustrating their locations.

Most often the coatings are applied directly to the die 12 instead of the preform 36. In this case, as shown in FIG. 1, the coating which produces a high coefficient of friction is applied in the areas of the die 12 which contact the portions of the preform 36 that are to undergo minimal or no expansion. A coating which will produce a low coefficient of friction is applied to the areas of the die 12 which contact portions of the preform 36 that are to undergo extensive expansion. For example, referring to FIG. 1, a coating 60, producing a high coefficient of friction, such as one containing yttria, is applied to the surface 34 and the die cavity entrance radius areas 52*a, b, c, d,* while a coating 62 producing a low coefficient of friction, such as one containing boron nitride, is applied to the side surfaces 42*a–d,* and the bottom surface 50.

There are advantages and drawbacks to each method. For example, if the coating is applied to the preform 36, the die 12 can be maintained at forming temperature which is important if high production rates are to be maintained. The drawback is that the preform 36 must be inserted accurately within the die 12, or the coatings may contact the die 12 in the wrong areas. Placing the coatings on the die 12 makes preform placement less critical, but the die must be cooled in order to apply the next coatings.

The benefits of the application of dual coatings can be shown by a brief discussion of the various stages of the SPF process shown in FIG. 2. As previously discussed, FIG. 2*a* shows the preform 36 positioned on the surface 34 of the die 12. Referring to FIG. 2*b,* after the preform and die are heated, fluid pressure is applied to the preform 36 in a manner well known in the art (such as described in previously mentioned U.S. Pat. No. 3,934,441). The preform 36 will freely expand into the cavity 32 of the die 12 with uniform thinning occurring in the center portion 68. In FIG. 2*c,* it can be seen that the continued application of pressure will pull the preform 36 around the radius areas 52*a–d,* and into partial contact with the side surfaces 42*a–d,* and with the center portion 68 contacting the bottom surface 50 of the die 12. Due to the high coefficient of friction between the preform 36 and the surface 34 of the die 12, little if any expansion in the form of elongations and thinning occur in this area. In radius areas 52*a–d,* where a high coefficient of friction also exists, some similar expansion also occurs because of the reasons previously mentioned. In the area of the side surfaces 42*a–d,* and the bottom surface 50, material is deforming with relative ease, and thus a considerable amount of expansion and thinning have occurred. In FIG. 2*d* the preform 36 is shown completely expanded into the cavity 32 of the die 12, taking on the shape of the structure 10. Ideally, all the expansion should occur in the cavity 32.

Figure 2C:
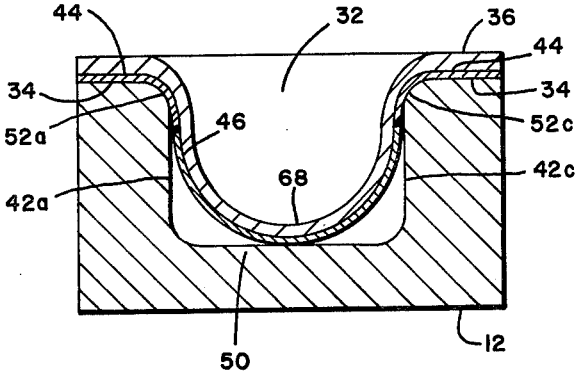
Figure 2D:
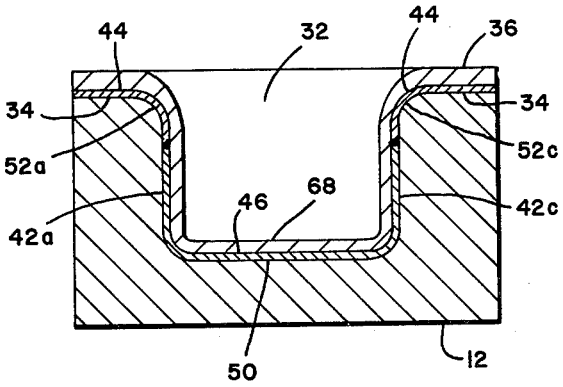

Had a single coating been used which produced a low coefficient of friction on all surfaces of the die 12, little resistance to preform movement would be provided at the radius areas 52*a–d* of the die 12, thus the force applied to the unsupported portions of the preform 36 would be transmitted to radius area 28 of the structure 10 (see FIG. 1) causing local necking. On the other hand, if a single coating which produces a high coefficient of friction were used, the radius area 28 of the structure 10 would undergo little expansion, but the center portion 68 of the preform 36 would also be subjected to high resistance forces. Referring to FIGS. 2*c* and 2*d* it can be seen that once the center portion 68 contacts the bottom 50 of the die 12 the resistance to expansion at the center becomes very great as well as in the area of contact between the preform 36 and side surfaces 42*a–d.* Thus, almost all the expansion would have to take place in the unsupported portions of the preform there between creating localized thinning which would be generally undesirable and totally unacceptable in a structural component.

Figure 4:
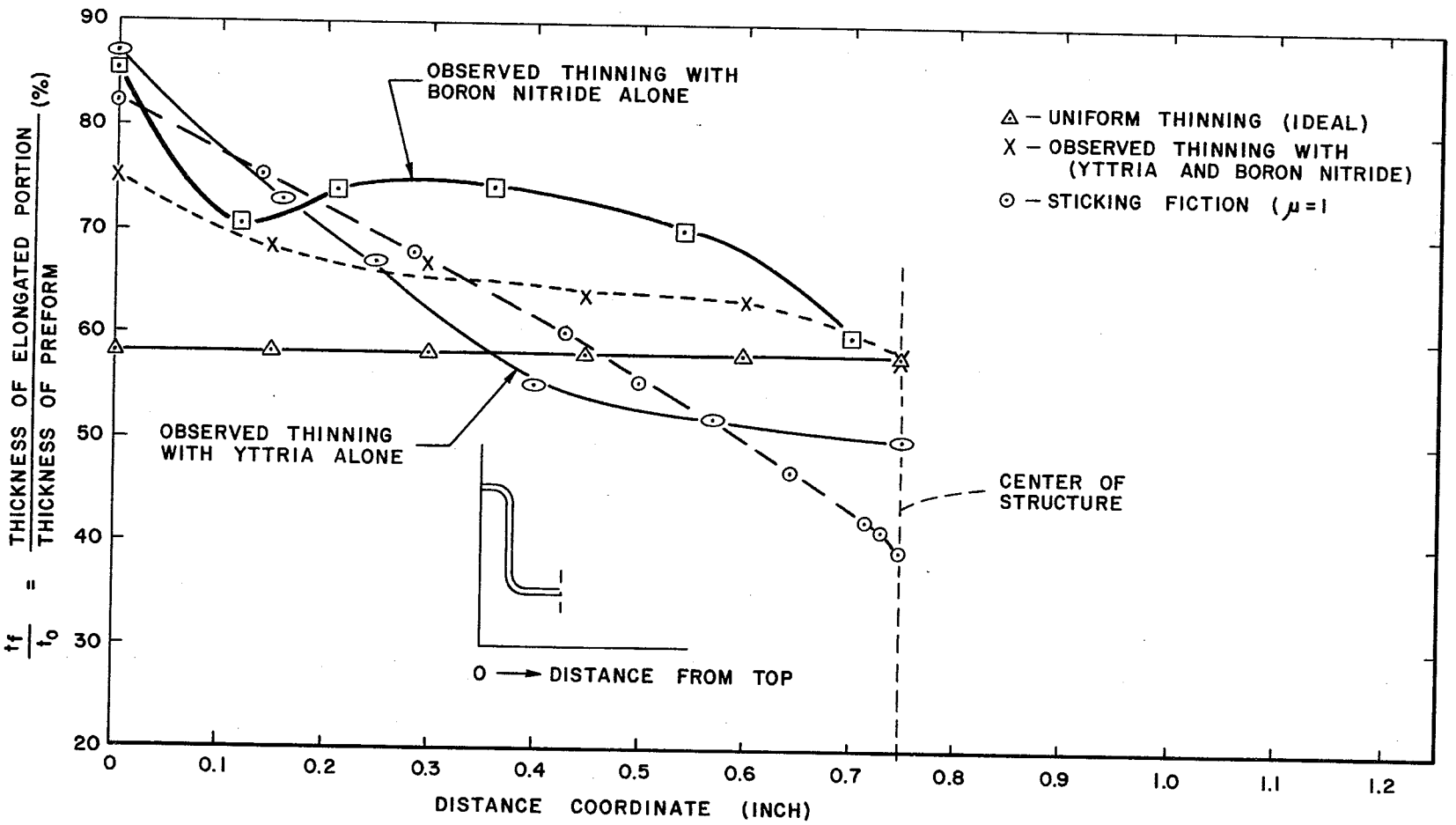
FIG. 4 is a graph illustrating the reduction in variation of thickness along the expanded portions of a structure actually achieved in the practice of the instant invention.

Shown in FIG. 4 is a graph illustrating the effectiveness of the dual coating of the instant invention. The ratio of the thickness of the expanded portion ($T_f$) to the thickness of the preform prior to expansion ($T_o$) is plotted as a function of a distance coordinate. The solid line represents the ideal situation where there is no friction and the ratio ($T_f/T_o$) is constant at approximately 58%. The dotted line represents what is actually achieved in practice with the instant invention, while the dashed line is a worst case situation where the coefficient of friction is 1. It can be seen in the other two curves that, when compounds containing boron nitride are used alone there is pronounced local thinning near the radius area 28 of the structure 10, while if compounds containing yttria are used alone there is extensive thinning continuing from the radius area 28 to the bottom 16. Thus, in the practice of this invention and particularly to the embodiments shown, the selection of coatings should be made on the basis of providing a large ratio of coefficients of friction while maintaining the properties heretofore set forth.

The process of applying a plurality of coatings having different coefficients of friction at different locations between the preform and the forming member is particularly effective in the SPF of metals. However the process could be used in any forming process, on both non-superplastic metals or non-metallics, where portions of a preform are formed against a forming member. Of course the selection of coatings are likely to differ from the ones suitable for SPF.

Having thus described the invention, it is obvious that numerous modification and departures may be made by those skilled in the art; thus, the invention is to be construed as being limited only by the spirit and scope of the appended claims.

What is claimed is:

1. In the method of making a structure by superplastic forming, wherein portions of a preform, are expanded in a superplastic condition against a forming member, the improvement comprising the step, prior to expanding said preform, of applying a material between said preform and said forming member that provides a lower coefficient of friction between said portions of said preform to be expanded and said forming member than exists between said portions of said preform where expansion is to be minimal and said forming member.

2. The method of claim 1 wherein said material is applied by:

applying a first release coating on said portions of said preform to be expanded; and applying a second release coating on said portions of said preform where expansion is to be minimal, said first release coating having a coefficient of friction less than said second release coating.

3. The method of claim 2 wherein said material is applied is by:

applying a first release coating to said forming member in position to contact said portions of said preform to be expanded; and applying a second release coating to said forming member in positions to contact said portions of said preform where expansion is to be minimal;

said first release coating having a coefficient of friction less than said second release coating.

4. The method of claim 1 wherein said preform is a titanium alloy.

5. The method of claim 2 of 3 wherein said first release coating is boron nitride.

6. The method of claim 2 or 4 wherein said second release coating is yttria.

7. In forming of metals wherein portions of a preform are applied against a forming member, the process comprising applying between said preform and said forming member a plurality of coatings having differing coefficients of friction, said coatings being applied, respectively, at different locations between said preform and said forming member, such that forming of the preform is uniform.

8. The process as set forth in claim 7 wherein said plurality of coating a first coating applied to said portions of the preform to be formed; and a second coating applied to said portions of said preform where forming is to be minimized, said first coating having a coefficient friction less than said second coating.

9. The process as set forth in claim 7 wherein said plurality of coatings are applied to said forming member.

10. The process as set forth in claim 9 wherein said coatings comprise:

a first coating applied to said forming member in positions to contact said portions of said preform to be formed; and a second coating applied to said forming member in positions to contact the portions of said preform where forming is to be minimal said first coating having a coefficient of friction less than said second coating.

11. The process as set forth in claim 7 wherein said preform is a metal having superplastic characteristics.

12. The process as set forth in claim 11 wherein said forming is superplastic forming.

13. The process as set forth in claim 11 wherein said preform is titanium.

14. The process as set forth in claims 9 or 11 wherein said first coating is boron nitride.

15. The process as set forth in claim 9 or 11 wherein said second coating is yttria.

* * * * *

UNITED STATES PATENT AND TRADEMARK OFFICE

CERTIFICATE OF CORRECTION

PATENT NO. : 4,269,053

DATED : May 26, 1981

INVENTOR(S) : Suphal P. Agrawal and Edward D. Weisert

It is certified that error appears in the above-identified patent and that said Letters Patent are hereby corrected as shown below:

IN THE CLAIMS:

Claim 8, line 2, delete "coating" and insert --coatings comprise:--.

Signed and Sealed this

*Twentieth* Day of *October 1981*

[SEAL]

*Attest:*

GERALD J. MOSSINGHOFF

*Attesting Officer*

*Commissioner of Patents and Trademarks*